US010160224B2

(12) United States Patent
Ge et al.

(10) Patent No.: US 10,160,224 B2
(45) Date of Patent: Dec. 25, 2018

(54) CARTRIDGES COMPRISING SENSORS INCLUDING GROUND ELECTRODES EXPOSED TO FLUID CHAMBERS

(71) Applicant: HEWLETT-PACKARD DEVELOPMENT COMPANY, L.P., Houston, TX (US)

(72) Inventors: Ning Ge, Palo Alto, CA (US); Patrick Leonard, Leixlip (IE); Adam L. Ghozeil, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/718,034

(22) Filed: Sep. 28, 2017

(65) Prior Publication Data

US 2018/0015729 A1 Jan. 18, 2018

Related U.S. Application Data

(63) Continuation of application No. 15/118,393, filed as application No. PCT/US2014/022063 on Mar. 7, 2014, now Pat. No. 9,776,419.

(51) Int. Cl.

| | |
|---|---|
| ***B41J 2/175*** | (2006.01) |
| ***B41J 2/045*** | (2006.01) |
| ***B41J 2/14*** | (2006.01) |

(52) U.S. Cl.

CPC ..... *B41J 2/17566* (2013.01); *B41J 2/04541* (2013.01); *B41J 2/04566* (2013.01); (Continued)

(58) Field of Classification Search

CPC ..... B41J 2/17566; B41J 2/14153; B41J 2/04541; B41J 2/1412; B41J 2/14072; (Continued)

(56) References Cited

U.S. PATENT DOCUMENTS 5,721,574 A * 2/1998 Kubby ..... B41J 2/04541 347/7

6,234,598 B1 5/2001 Torgerson et al.

(Continued)

FOREIGN PATENT DOCUMENTS

| | | |
|---|---|---|
| EP | 1125745 | 8/2001 |
| EP | 2008822 | 12/2008 |

(Continued)

OTHER PUBLICATIONS

Unknown, "Sermar Machines—Lexmark", Lexmark's Mustang Industrial Inkjet Printer dated on or before Mar. 2010 (6 pages).

(Continued)

*Primary Examiner* — Bradley Thies

(74) *Attorney, Agent, or Firm* — HP Inc.-Patent Department

(57) ABSTRACT

In some examples, a cartridge includes a printhead comprising a fluid feed slot, a fluid chamber formed between a nozzle layer and a passivation layer, the fluid chamber fluidically coupling the fluid feed slot and a nozzle of the nozzle layer, and a printhead-integrated sensor to sense a property of a fluid in the fluid chamber, the sensor including a ground electrode exposed to the fluid chamber through an opening in the passivation layer.

20 Claims, 12 Drawing Sheets

(52) U.S. Cl.
CPC ..... *B41J 2/04571* (2013.01); *B41J 2/1412* (2013.01); *B41J 2/14072* (2013.01); *B41J 2/14129* (2013.01); *B41J 2/14153* (2013.01); *B41J 2002/14354* (2013.01); *B41J 2202/18* (2013.01)

(58) Field of Classification Search
CPC ..... B41J 2/04571; B41J 2/04566; B41J 2/14129; B41J 2202/18; B41J 2002/14354
See application file for complete search history.

(56) References Cited

U.S. PATENT DOCUMENTS

| | | | |
|---|---|---|---|
| 8,065,913 | B2 | 11/2011 | McCracken et al. |
| 8,384,222 | B2 | 2/2013 | Tsai et al. |
| 8,444,255 | B2 | 5/2013 | Bakker et al. |
| 2003/0081027 | A1 | 5/2003 | Feinn et al. |
| 2003/0081071 | A1 | 5/2003 | Giere et al. |
| 2007/0153032 | A1 | 7/2007 | Chou et al. |
| 2008/0231651 | A1 | 9/2008 | Jung |
| 2014/0204148 | A1 | 7/2014 | Ge |

FOREIGN PATENT DOCUMENTS

| | | |
|---|---|---|
| TW | I273035 | 2/2007 |
| WO | WO-2013/002762 A1 | 1/2013 |
| WO | WO-2013002762 | 1/2013 |
| WO | WO-2013002762 A1 | 1/2013 |

OTHER PUBLICATIONS

Korean Intellectual Property Office, International Search Report and Written Opinion for PCT/US2014/022063 dated May 19, 2015 (13 pages).
Sermar Machines—Lexmark. Lexmark's Mustang Industrial Inkjet Printer dated on or before Mar. 2010 (6 pages).

* cited by examiner

CARTRIDGES COMPRISING SENSORS INCLUDING GROUND ELECTRODES EXPOSED TO FLUID CHAMBERS

CROSS REFERENCE TO RELATED APPLICATIONS

This is a continuation of U.S. application Ser. No. 15/118,393, having a national entry date of Oct. 14, 2016, which is a national stage application under 35 U.S.C. § 371 of PCT/US2014/022063, filed Mar. 7, 2014, which are both hereby incorporated by reference in their entirety.

BACKGROUND

Some printing systems may be endowed with devices for determining the level of a fluid, such as ink, in a reservoir or other fluidic chamber. For example, prisms may be used to reflect or refract light beams in ink cartridges to generate electrical and/or user-viewable ink level indications. Some systems may use backpressure indicators to determine ink levels in a reservoir. Other printing systems may count the number of ink drops ejected from inkjet print cartridges as a way of determining ink levels. Still other systems may use the electrical conductivity of the ink as an ink level indicator in printing systems.

BRIEF DESCRIPTION OF THE DRAWINGS

The detailed description section references the drawings, wherein.

Figure 1:
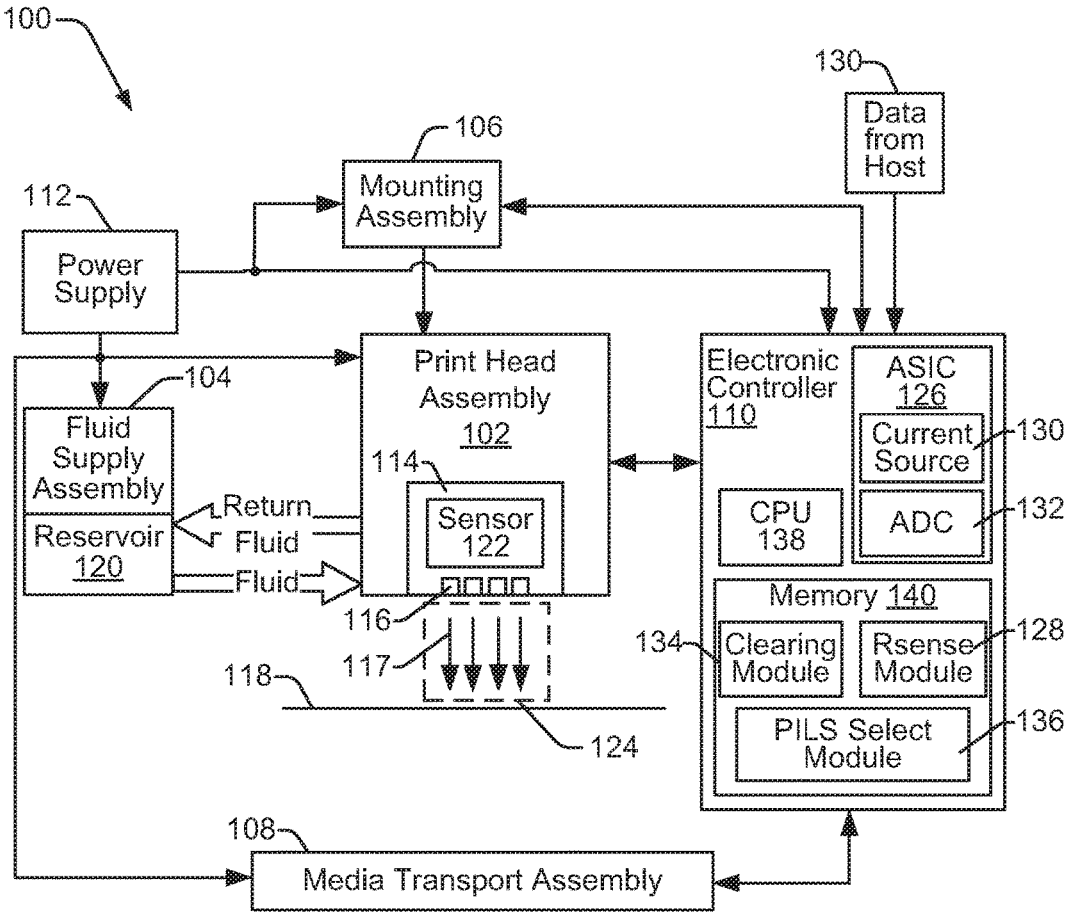
FIG. 1 is a block diagram of an example of a fluid ejection system suitable for incorporating printhead-integrated sensors.

all in which various embodiments may be implemented.

Examples are shown in the drawings and described in detail below. The drawings are not necessarily to scale, and various features and views of the drawings may be shown exaggerated in scale or in schematic for clarity and/or conciseness. The same part numbers may designate the same or similar parts throughout the drawings.

DETAILED DESCRIPTION

There are a number of techniques available for determining a property of a fluid, such as ink, in a reservoir or other fluidic chamber. Accurate ink level sensing in ink supply reservoirs for many types of inkjet printers, for instance, may be desirable for a number of reasons. For example, sensing the correct level of ink and providing a corresponding indication of the amount of ink left in an ink cartridge allows printer users to prepare to replace finished ink cartridges. Accurate ink level indications also help to avoid wasting ink, since inaccurate ink level indications often result in the premature replacement of ink cartridges that still contain ink. In addition, printing systems can use ink level sensing to trigger certain actions that help prevent low quality prints that might result from inadequate supply levels.

Described herein are various implementations of printhead-integrated sensors and sensing techniques, and apparatuses and systems endowed with such sensors and/or sensing techniques in which a ground electrode for the sensor(s) is exposed to the fluid chamber for directly contacting a fluid in the fluid chamber. In various implementations, the sensors may sense a property (e.g., fluid level, temperature, etc.) of the fluid and may be integrated onboard a thermal inkjet (TU) printhead die. For example, the sensors may comprise printhead-integrated ink level sensors (PILS). In some of the implementations, the sense circuit may implement a sample and hold technique that captures the ink level state of the fluid ejection device through a capacitive sensor. The capacitance of the capacitive sensor may change with the level of ink. For each PILS, a charge placed on the capacitive sensor may be shared between the capacitive sensor and a reference capacitor, causing a reference voltage at the gate of an evaluation transistor. A current source in a printer application specific integrated circuit (ASIC) may supply current at the transistor drain. The ASIC may measure the resulting voltage at the current source and calculate the corresponding drain-to-source resistance of the evaluation transistor. The ASIC may then determine the ink level status of the fluid ejection device based on the resistance determined from the evaluation transistor.

In various implementations, the ground electrode exposed to the fluid chamber may provide a ground for the sense circuit. The ground electrode may include a first metal layer exposed to the fluid chamber through a via in the passivation layer, and a second metal layer on the first metal layer and connected to an on-die ground path. In various implementations, the passivation layer may shield the second metal layer from the fluid chamber.

In various implementations, accuracy may be improved through the use of multiple PILS integrated on a printhead die. For example, a fluid ejection device may include a first PILS to sense an ink level of a first fluid chamber in fluid communication with the fluid feed slot, and a second PILS to sense an ink level of a second fluid chamber in fluid communication with the fluid feed slot. A shift register may serve as a selective circuit to address the multiple PILS and enable the ASIC to measure multiple voltages and determine the ink level status based on measurements taken at various locations on the printhead die. In various implementations, a fluid chamber in fluid communication with a fluid feed slot of the fluid ejection device may include a clearing resistor circuit to clear the fluid chamber of ink.

In various implementations, a processor-readable medium may store code representing instructions that when executed by a processor cause the processor to initiate operation of a first printhead-integrated ink level sensor (PILS) of a first fluid chamber in fluid communication with a fluid feed slot of the fluid ejection device and a second PILS of a second fluid chamber in fluid communication with the fluid feed slot. A shift register may be controlled to multiplex outputs from the first PILS and the second PILS onto a common ID line. From the outputs, an ink level state of the fluid ejection device may be determined based on differing ink levels sensed by the first PILS and the second PILS.

In various implementations, a processor-readable medium may store code representing instructions that when executed by a processor cause the processor to activate a clearing resistor circuit to purge ink from a fluid chamber, apply a pre-charge voltage Vp to a sense capacitor within the fluid chamber to charge the sense capacitor with a charge Q1. The charge Q1 may be shared between the sense capacitor and a reference capacitor, causing a reference voltage Vg at the gate of an evaluation transistor. A resistance may be determined from drain to source of the evaluation transistor that results from Vg. In an implementation, a delay may be provided after activating the clearing resistor circuit to enable ink from a fluid slot to flow back into the fluid chamber prior to applying the pre-charge voltage Vp.

Turning now to FIG. 1, illustrated is a block diagram of an example fluid ejection system 100 suitable for incorporating a fluid ejection device comprising printhead-integrated sensors as disclosed herein. In various implementations, the fluid ejection system 100 may comprise an inkjet printer or printing system. The fluid ejection system 100 may include a printhead assembly 102, a fluid supply assembly 104, a mounting assembly 106, a media transport assembly 108, an electronic controller 110, and at least one power supply 112 that may provide power to the various electrical components of fluid ejection system 100.

The printhead assembly 102 may include at least one printhead 114. The printhead 114 may comprise a printhead die having a fluid feed slot along a length of a printhead die to supply a fluid, such as ink, for example, to a plurality of nozzles 116. The plurality of nozzles 116 may eject ejects drops of the fluid toward a print media 118 so as to print onto the print media 118. The print media 118 may be any type of suitable sheet or roll material, such as, for example, paper, card stock, transparencies, polyester, plywood, foam board, fabric, canvas, and the like. The nozzles 116 may be arranged in one or more columns or arrays such that properly sequenced ejection of fluid from nozzles 116 may cause characters, symbols, and/or other graphics or images to be printed on the print media 118 as the printhead assembly 102 and print media 118 are moved relative to each other.

The fluid supply assembly 104 may supply fluid to the printhead assembly 102 and may include a reservoir 120 for storing the fluid. In general, fluid may flow from the reservoir 120 to the printhead assembly 102, and the fluid supply assembly 104 and the printhead assembly 102 may form a one-way fluid delivery system or a recirculating fluid delivery system. In a one-way fluid delivery system, substantially all of the fluid supplied to the printhead assembly 102 may be consumed during printing. In a recirculating fluid delivery system, however, only a portion of the fluid supplied to the printhead assembly 102 may be consumed during printing. Fluid not consumed during printing may be returned to the fluid supply assembly 104. The reservoir 120 of the fluid supply assembly 104 may be removed, replaced, and/or refilled.

The mounting assembly 106 may position the printhead assembly 102 relative to the media transport assembly 108, and the media transport assembly 108 may position the print media 118 relative to the printhead assembly 102. In this configuration, a print zone 124 may be defined adjacent to the nozzles 116 in an area between the printhead assembly 102 and print media 118. In some implementations, the printhead assembly 102 is a scanning type printhead assembly. As such, the mounting assembly 106 may include a carriage for moving the printhead assembly 102 relative to the media transport assembly 108 to scan the print media 118. In other implementations, the printhead assembly 102 is a non-scanning type printhead assembly. As such, the mounting assembly 106 may fix the printhead assembly 102 at a prescribed position relative to the media transport assembly 108. Thus, the media transport assembly 108 may position the print media 118 relative to the printhead assembly 102.

The electronic controller 110 may include a processor (CPU) 138, memory 140, firmware, software, and other electronics for communicating with and controlling the printhead assembly 102, mounting assembly 106, and media transport assembly 108. Memory 140 may include both volatile (e.g., RAM) and nonvolatile (e.g., ROM, hard disk, floppy disk, CD-ROM, etc.) memory components comprising computer/processor-readable media that provide for the storage of computer/processor-executable coded instructions, data structures, program modules, and other data for the printing system 100. The electronic controller 110 may receive data 130 from a host system, such as a computer, and temporarily store the data 130 in memory 140. Typically, the data 130 may be sent to the printing system 100 along an electronic, infrared, optical, or other information transfer path. The data 130 may represent, for example, a document and/or file to be printed. As such, the data 130 may form a print job for the printing system 100 and may include one or more print job commands and/or command parameters.

In various implementations, the electronic controller 110 may control the printhead assembly 102 for ejection of fluid drops 117 from the nozzles 116. Thus, the electronic controller 110 may define a pattern of ejected fluid drops 117 that form characters, symbols, and/or other graphics or images on the print media 118. The pattern of ejected fluid drops 117 may be determined by the print job commands and/or command parameters from the data 130.

In various implementations, the electronic controller 110 may include a printer application specific integrated circuit (ASIC) 126 to determine at least one property (e.g., a fluid level, temperature, etc.) of ink in the fluid ejection device/printhead 114. For implementations in which at least some of the sensors 122 comprise PILS, the ASIC 126 may determine a fluid level of corresponding fluid chambers based on resistance values from one or more PILS. The printer ASIC 126 may include a current source 130 and an analog-to-digital converter (ADC) 132. The ASIC 126 may convert the voltage present at current source 130 to determine a resistance, and then determine a corresponding digital resistance value through the ADC 132. A programmable algorithm implemented through executable instructions within a resistance-sense module 128 in memory 140 may enable the resistance determination and the subsequent digital conversion through the ADC 132. In various implementations, the memory 140 of electronic controller 110 may include a programmable algorithm implemented through executable instructions within an ink clearing module 134 that comprises instructions executable by the processor 138 of the controller 110 to activate a clearing resistor circuit on the integrated printhead 114 to purge ink and/or ink residue out of a PILS fluid chamber. In another implementation, where the printhead 114 comprises multiple PILS, the memory 140 of the electronic controller 110 may include a programmable algorithm implemented through executable instructions within a PILS select module 136 executable by the processor 138 of the controller 110 to control a shift register for selecting individual PILS to be used to sense ink levels to determine an ink level state of the fluid ejection device.

In various implementations, the printing system 100 is a drop-on-demand thermal inkjet printing system with a thermal inkjet (TU) printhead 114 suitable for implementing a printhead die 114 having a plurality of sensors 122 and ground electrodes for the sensors 122, as described herein. In some implementations, the printhead assembly 102 may include a single TU printhead 114. In other implementations, the printhead assembly 102 may include a wide array of TIJ printheads 114. While the fabrication processes associated with TIJ printheads are well suited to the integration of the printhead dies described herein, other printhead types such as a piezoelectric printhead can also implement a printhead die 114 having a plurality of sensors 122 and associated ground electrodes.

Figure 2:
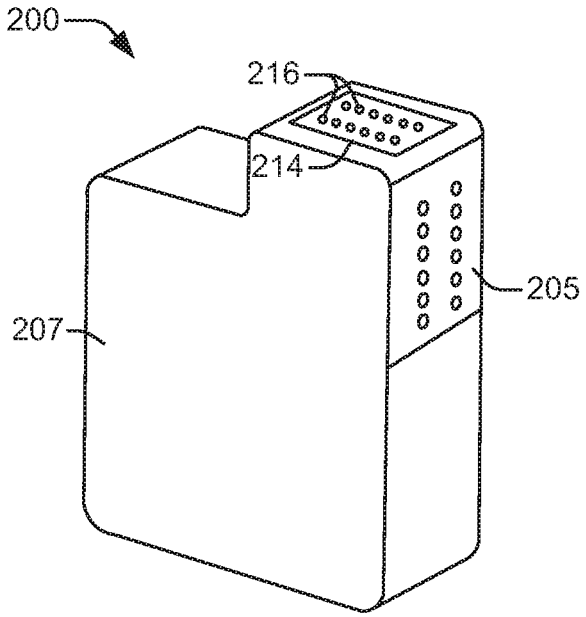
FIG. 2 is a perspective view of an example fluid ejection cartridge suitable for incorporating printhead-integrated sensors.

In various implementations, the printhead assembly 102, fluid supply assembly 104, and reservoir 120 may be housed together in a replaceable device such as an integrated printhead cartridge. FIG. 2 is a perspective view of an example inkjet cartridge 200 that may include the printhead assembly 102, ink supply assembly 104, and reservoir 120, according to an implementation of the disclosure.

In addition to one or more printheads 114, inkjet cartridge 200 may include electrical contacts 205 and an ink (or other fluid) supply chamber 207. In some implementations, the cartridge 200 may have a supply chamber 207 that stores one color of ink, and in other implementations it may have a number of chambers 207 that each store a different color of ink. The electrical contacts 205 may carry electrical signals to and from a controller (such as, e.g., the electrical controller 110 described herein with reference to FIG. 1) and power (from the power supply 112 described herein with reference to FIG. 1) to cause the ejection of ink drops through the nozzles 216 and make ink level measurements.

Figure 3:
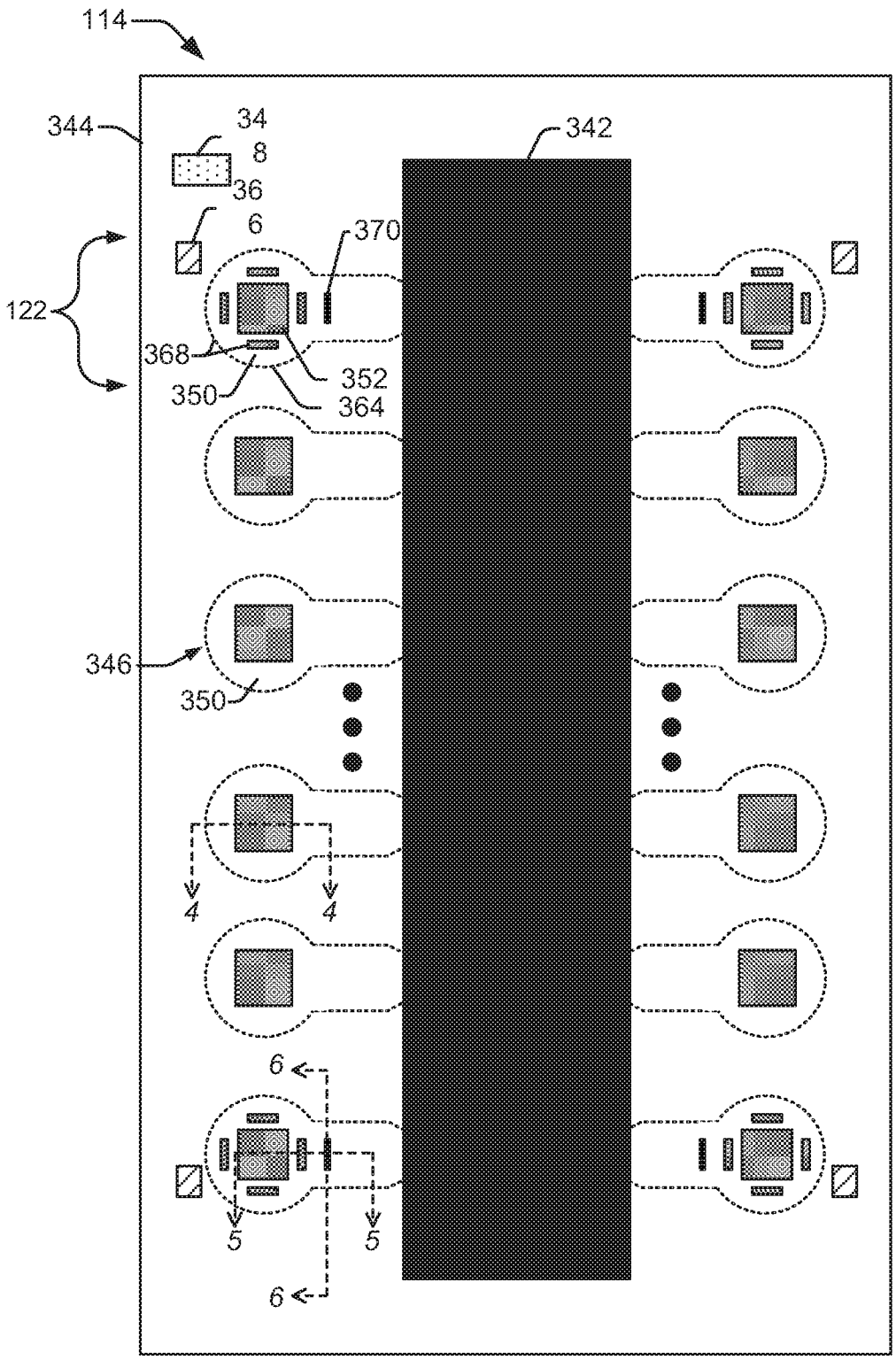
FIG. 3 is a bottom view of a printhead including a fluid feed slot and printhead-integrated ink level sensors (PILS)
Figure 4:
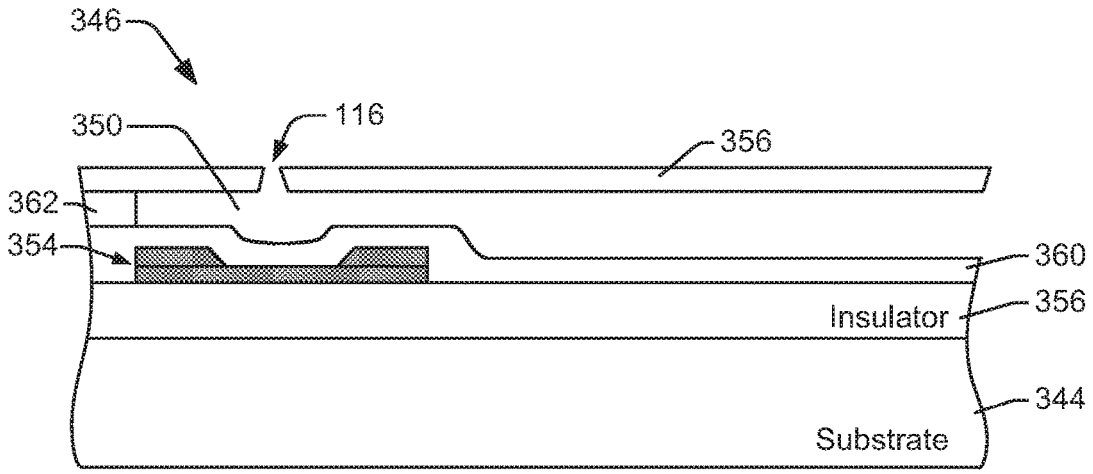
FIG. 4 is a cross-sectional view of an example fluid drop generator.
Figure 5:
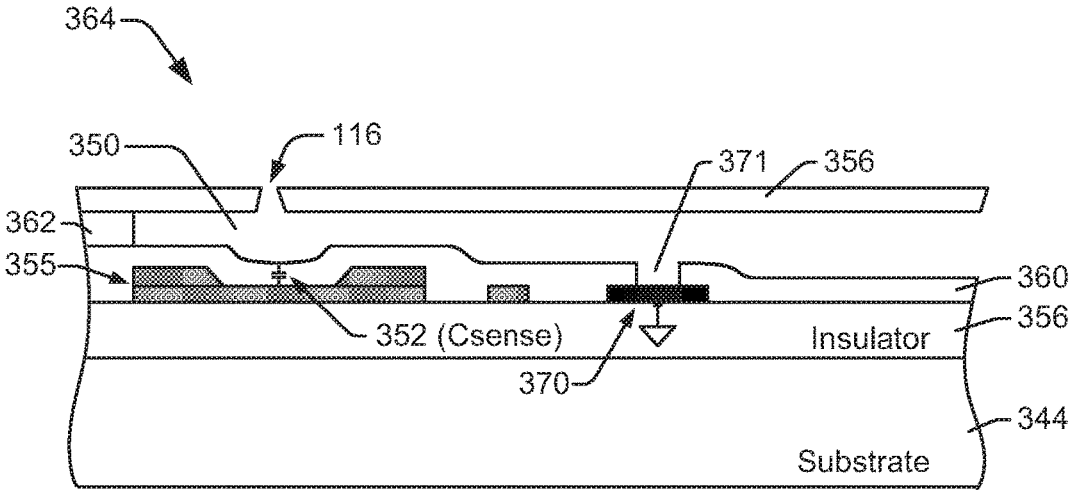
FIG. 5 is a cross-sectional view of an example sense structure.
Figure 6:
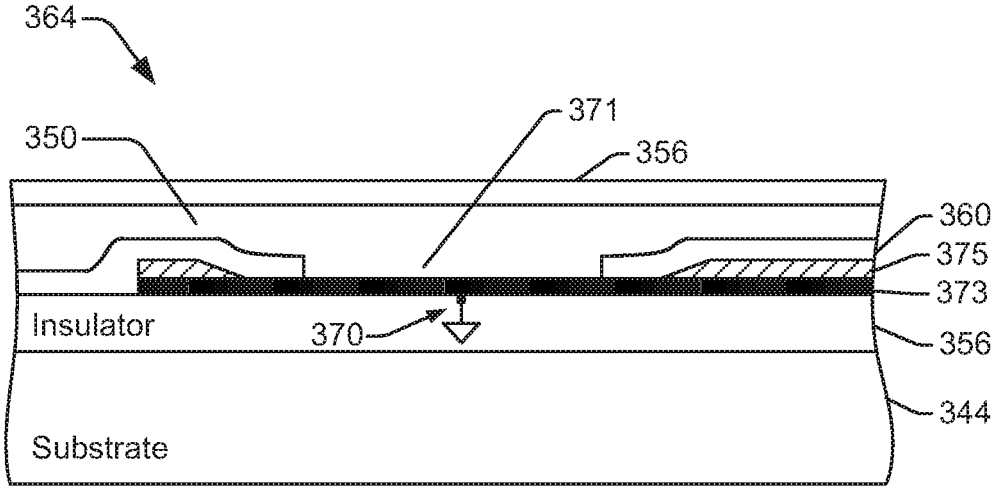
FIG. 6 is another cross-sectional view of the example sense structure of FIG. 7.

FIG. 3 shows a bottom view of an example implementation of a TIJ printhead 114 including sensors 122 comprising PILS (hereinafter "PILS 122). FIGS. 4, 5, and 6 show various sectional views of the TIJ printhead 114 as indicated by hashed lines 4-4, 5-5, and 6-6, respectively. As shown, the printhead 114 may include a fluid feed slot 342 formed in a silicon die/substrate 344, in accordance with various implementations. Various components integrated on the printhead die/substrate 344 may include fluid drop generators 346, a plurality of PILS 122 and related circuitry, and a shift register 348 coupled to each PILS 122 to enable multiplexed selection of individual PILS 122, as discussed in greater detail below. Although the printhead 114 is shown with a single fluid slot 342, the principles discussed herein are not limited in their application to a printhead with just one slot 342. Rather, other printhead configurations may also be possible, such as printheads with two or more fluid feed slots. In the TU printhead 114, the die/substrate 344 underlies a chamber layer having fluid chambers 350 and a nozzle layer having nozzles 116 formed therein, as discussed below with respect to FIGS. 4 and 5. For the purpose of illustration, however, the chamber layer and nozzle layer in FIG. 3 is assumed to be transparent in order to show the underlying substrate 344. The fluid chambers 350, therefore, are illustrated using dashed lines in FIG. 3.

The fluid feed slot 342 may be an elongated slot formed in the substrate 344. The fluid feed slot 342 may be in fluid communication with a fluid supply (not shown), such as a fluid reservoir 120 shown in FIG. 1. The fluid feed slot 342 may include multiple fluid drop generators 346 arranged along both sides of the fluid feed slot 342, as well as a plurality of PILS 122. Each of the PILS 122 may be in fluid communication with the fluid feed slot 342 and may be configured to sense an ink level of its respective fluid chamber 350, as described more fully herein. In various implementations, the PILS 122 may be located generally toward the fluid feed slot 342 ends, as shown, along either side of the fluid feed slot 342. For example, in some implementations, a fluid ejection device may include four PILS 122 per fluid feed slot 342, each PILS 122 located generally near one of four corners of the fluid feed slot 342, toward the ends of the fluid feed slot 342. In other implementations, a fluid ejection device may include more than four PILS 122 per fluid feed slot 342, at least one PILS 122 located generally near one of four corners of the fluid feed slot 342, toward the ends of the fluid feed slot 342. As shown, for example, the printhead 114 includes four PILS 122 per fluid feed slot 342, with one PILS 122 located generally near one of the four corners of the fluid feed slot 342, toward the ends of the fluid feed slot 342. Various other configurations may be possible within the scope of the present disclosure.

While each PILS 122 is typically located near an end-corner of the fluid feed slot 342, as shown in FIG. 3, this is not intended as a limitation on other possible locations of a PILS 122. Thus, PILS 122 can be located around the fluid feed slot 342 in other areas such as midway between the ends of the fluid feed slot 342. In some implementations, a PILS 122 may be located on one end of the fluid feed slot 342 such that it extends outward from the end of the fluid feed slot 342 rather than from the side edge of the fluid feed slot 342. As shown in FIG. 3, however, for PILS 122 located generally near end-corners of a fluid feed slot 342, it may be advantageous to maintain a certain safe distance between the plate sense capacitor (Csense) 352 of the PILS 122 (e.g., between one edge of the plate sense capacitor 352) and the end of the fluid feed slot 342. Maintaining a minimum safe distance may help to ensure that there is no signal degradation from the sense capacitor (Csense) 352 due to the potential of reduced fluid flow rate that may be encountered at the ends of the fluid feed slots 342. In some implementations, a minimum safe distance to maintain between the plate sense capacitor (Csense) 352 and the end of the fluid feed slot 342 may be at least 40 μm, and in some implementations, at least about 50 μm.

Turning now to FIGS. 4, 5, and 6, with continued reference to FIGS. 1-3, illustrated are sectional views of the TIJ printhead 114 taken along hashed lines 4-4, 5-5, and 6-6, respectively. As shown in FIG. 4, the drop generator 346 may include a nozzle 116, a fluid chamber 350, and a metal plate 354 that forms a firing element disposed in the fluid chamber 350. The nozzles 116 may be formed in a nozzle layer 356 and may be generally arranged to form nozzle columns along the sides of the fluid feed slot 342. The firing element 354 may be a thermal resistor formed of a dual metal layer metal plate (e.g., aluminum copper (AlCu), tantalum-aluminum (TaAl), AlCu on TaAl, or AlCu on tungsten silicon nitride (WSiN)) on an insulating layer 356

(e.g., phosphosilicate glass (PSG), undoped silicate glass (USG), borophosphosilicate glass (BPSG), or a combination thereof) on a top surface of the silicon substrate 344. A passivation layer 360 over the firing element 354 may protect the firing element 354 from ink in the fluid chamber 350 and may act as a mechanical passivation or protective cavitation barrier structure to absorb the shock of collapsing vapor bubbles. A chamber layer 362 may have walls and fluid chambers 350 that separate the substrate 358 from the nozzle layer 356.

During operation, a fluid drop may be ejected from a fluid chamber 350 through a corresponding nozzle 116 and the fluid chamber 350 may then be refilled with fluid circulating from fluid feed slot 352. More specifically, an electric current may be passed through a resistor firing element 354 resulting in rapid heating of the element. A thin layer of fluid adjacent to the passivation layer 360 over the firing element 354 may be superheated and vaporized, creating a vapor bubble in the corresponding firing fluid chamber 350. The rapidly expanding vapor bubble may be a fluid drop out of the corresponding nozzle 116. When the heating element cools, the vapor bubble may quickly collapse, drawing more fluid from fluid feed slot 342 into the firing fluid chamber 350 in preparation for ejecting another drop from the nozzle 116.

FIG. 5 is a sectional view of a portion of an example sense structure 364 of a PILS 122, in accordance with various implementations. As shown in FIG. 3, the PILS 122 generally may include the sense structure 364, sensor circuitry 366, and a clearing resistor circuit 368, integrated on the printhead 114. The sense structure 364 of the PILS 122 may be generally configured in the same manner as a drop generator 356, but includes a clearing resistor circuit 368 and a ground electrode 370 for the sense capacitor (Csense) 352 through the substance (e.g., ink, ink-air, air) in the PILS fluid chamber 350. Therefore, like a typical drop generator 356, the sense structure 364 includes a nozzle 116, a fluid chamber 350, a conductive element such as a metal plate 355 disposed within the fluid/ink chamber 350, a passivation layer 360 over the metal plate 355, and an insulating layer 356 (e.g., polysilicon glass, PSG) on a top surface of the silicon substrate 344. However, as discussed above with reference to FIG. 1, a PILS 122 may additionally employ a current source 130 and analog to digital convertor (ADC) 132 from a printer ASIC 126 that is not integrated onto the printhead 114. Instead, the printer ASIC 126 may be located, for example, on the printer carriage or electronic controller 110 of the printer system 100.

Within the sense structure 364, a sense capacitor (Csense) 352 may be formed by the metal plate 355, the passivation layer 360, and the substance or contents of the fluid chamber 350. The sensor circuitry 366 may incorporate sense capacitor (Csense) 352 from within the sense structure 352. The value of the sense capacitor 352 may change as the substance within the fluid chamber 350 changes. The substance in the fluid chamber 350 can be all ink, ink and air, or just air. Thus, the value of the sense capacitor 352 changes with the level of ink in the fluid chamber 350. When ink is present in the fluid chamber 350, the sense capacitor 352 has good conductance to ground 370 so the capacitance value is highest (e.g., 100%). However, when there is no ink in the fluid chamber 350 (e.g., air only) the capacitance of sense capacitor 352 drops to a very small value, which is ideally close to zero. When the fluid chamber contains ink and air, the capacitance value of sense capacitor 352 may be somewhere between zero and 100%. Using the changing value of the sense capacitor 352, the ink level sensor circuitry 366 may enable a determination of the ink level. In general, the ink level in the fluid chamber 350 may be indicative of the ink level state of ink in reservoir 120 of printer system 100.

In some implementations, a clearing resistor circuit 368 may be used to purge ink and/or ink residue from the fluid chamber 350 of the PILS sense structure 364 prior to measuring the ink level with sensor circuit 366. Thereafter, to the extent that ink is present in the reservoir 120, it may flow back into the fluid chamber to enable an accurate ink level measurement. As shown in FIG. 3, in various implementations a clearing resistor circuit 368 may include four clearing resistors surrounding the metal plate 355 of the sense capacitor (Csense) 352. Each clearing resistor 368 may be adjacent to one of the four sides of the metal plate 355 of the sense capacitor (Csense) 352. The clearing resistors 368 may comprise thermal resistors formed, for example, of AlCu, TaAl, or AlCu on TaAl, such as discussed above, that may provide rapid heating of the ink to create vapor bubbles that force ink out of the PILS fluid chamber 350. The clearing resistor circuit 368 may purge ink from the fluid chamber 350 and remove residual ink from the metal plate 355 of sense capacitor (Csense) 352. Ink flowing back into the PILS fluid chamber 350 from the fluid feed slot 342 then may enable a more accurate sense of the ink level through sense capacitor (Csense) 352. In some implementations, a delay may be provided by controller 110 after the activation of the clearing resistor circuit 368 to provide time for ink from fluid feed slot 342 to flow back into the PILS fluid chamber 350 prior to sensing the ink level in the PILS fluid chamber 350. While the clearing resistor circuit 368 having four resistors surrounding the sense capacitor (Csense) 352 may have an advantage of providing for a significant clearing of ink from the sense capacitor 352 and PILS fluid chamber 350, other clearing resistor configurations are also contemplated that may provide clearing of ink to lesser or greater degrees. For example, a clearing resistor circuit 368 may be configured with an in-line resistor configuration in which the clearing resistors are in-line with one another, adjacent the back edge of the metal plate 355 of sense capacitor (Csense) 352 at the back side of the PILS fluid chamber 350 away from the fluid feed slot 342.

As shown, the ground electrode 370 of the sense structure 364 may be exposed to the fluid chamber 350 through a via 371 in the passivation layer 360. As shown in FIG. 6, the ground electrode 370 may comprise a first metal layer 373 and a second metal layer 375 on the first metal layer 373, the via 371 in the passivation layer 360 exposing a portion of the first metal layer 373 to the fluid chamber 350. The second metal layer 375 may be connected to an on-die ground path (not shown) from electrically connecting the first metal layer 373 to ground.

The ground electrode 370 may be fabricated in a similar manner, and in at least some implementations, during the same operations, as the firing element 354 and/or the metal plate 355 of sense capacitor (Csense) 352, which may simplify, or at least minimize additional complexity in the process flow for fabricating the printhead. As shown in FIG. 6, the ground electrode 370 may comprise a dual metal layer structure similar to the firing element 354, with the second metal layer 375 having a sloped edge resulting from a wet etch operation to expose the underlying first metal layer 373, as discussed in further detail below.

Although the first metal layer 373 and the second metal layer 375 may comprise any conductive material suitable for the application (such as, e.g., AlCu, TaAl, WSiN, etc.), in many implementations the dual metal layer structure of the ground electrode 370 may allow the first metal layer 373 to be fabricated with a metal having more resistance to corrosion by the fluid in the fluid chamber 350 (e.g., ink) than the metal of the second metal layer 375, with the passivation layer 360 shielding the second metal layer 375 from the fluid chamber 350, as shown. Although some implementations may include a ground electrode 370 in which the first metal layer 373 and the second metal layer 375 comprise the same metal or metal alloy, other implementations in which the ground electrode 370 comprises two different metals or metal alloys may allow for greater design flexibility, which may in turn allow for a cost reduction by using less expensive metals or metal alloys when possible. In addition, the overall fabrication of the printhead may be simplified by using the same process operation(s) for fabricating the ground electrode 370 as those used for fabricating the firing element 354 and/or the metal plate 355 of sense capacitor (Csense) 352.

Figure 7:
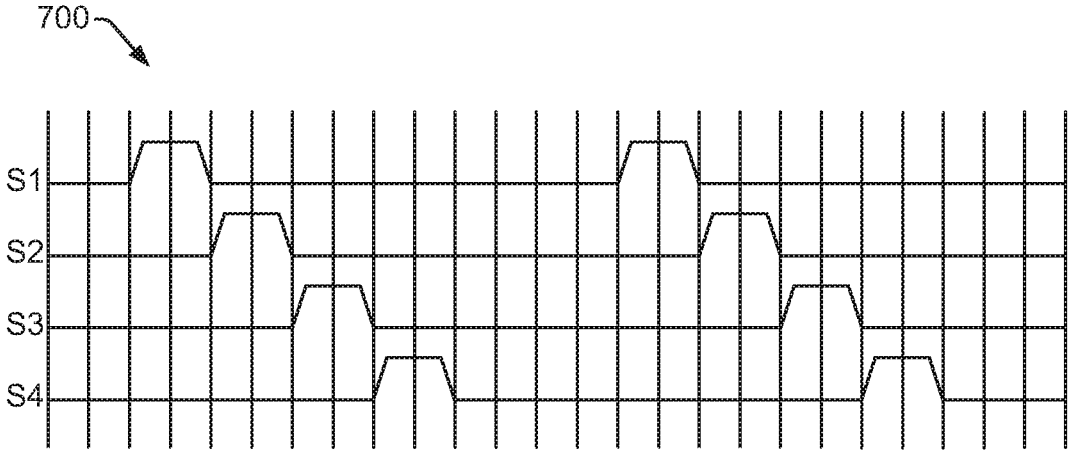
FIG. 7 is a timing diagram of non-overlapping clock signals used to drive a printhead.

FIG. 7 is an example of a partial timing diagram 700 having non-overlapping clock signals (S1-S4) with synchronized data and fire signals that may be used to drive a printhead 114, in accordance with various implementations. The clock signals in the timing diagram 700 may also be used to drive the operation of the PILS ink level sensor circuit 366 and shift register 348 as discussed below.

Figure 8:
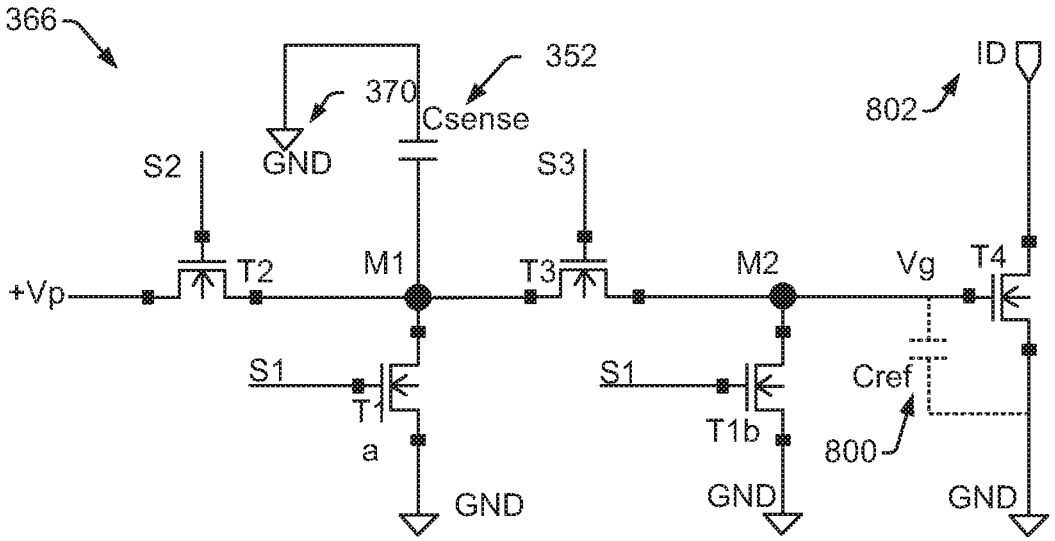
FIG. 8 is an example ink level sensor circuit.

FIG. 8 is an example ink level sensor circuit 366 of a PILS 122, in accordance with various implementations. In general, the sensor circuit 366 may employ a charge sharing mechanism to determine different levels of ink in a PILS fluid chamber 350. The sensor circuit 366 may include two first transistors, T1 (T1*a*, T1*b*), configured as switches. Referring to FIGS. 7 and 8, during operation of the sensor circuit 366, in a first step a clock pulse S1 is used to close the transistor switches T1*a* and T1*b*, coupling memory nodes M1 and M2 to ground and discharging the sense capacitor 352 and the reference capacitor 800. The reference capacitor 800 may be the capacitance between node M2 and ground. In this example, the reference capacitor 800 may be implemented as the inherent gate capacitance of evaluation transistor T4, and it is therefore illustrated using dashed lines. The reference capacitor 800 may additionally include associated parasitic capacitance such as gate-source overlap capacitance, but the T4 gate capacitance is the dominant capacitance in reference capacitor 800. Using the gate capacitance of transistor T4 as a reference capacitor 800 reduces the number of components in sensor circuit 366 by avoiding a specific reference capacitor fabricated between node M2 and ground. In other implementations, however, it may be beneficial to adjust the value of reference capacitor 800 through the inclusion of a specific capacitor fabricated from M2 to ground (e.g., in addition to the inherent gate capacitance of T4).

In a second step, the S1 clock pulse terminates, opening the T1*a* and T1*b* switches. Directly after the T1 switches open, an S2 clock pulse is used to close transistor switch T2. Closing T2 couples node M1 to a pre-charge voltage, Vp (e.g., on the order of +15 volts), and a charge Q1 is placed across sense capacitor 352 according to the equation, Q1=(Csense)*(Vp). At this time the M2 node remains at zero voltage potential since the S3 clock pulse is off. In a third step, the S2 clock pulse terminates, opening the T2 transistor switch. Directly after the T2 switch opens, the S3 clock pulse closes transistor switch T3, coupling nodes M1 and M2 to one another and sharing the charge Q1 between sense capacitor 352 and reference capacitor 800. The shared charge Q1 between sense capacitor 352 and reference capacitor 800 results in a reference voltage, Vg, at node M2 which is also at the gate of evaluation transistor T4, according to the following equation:

$$Vg = \left(\frac{Csense}{Csense + Cref}\right)Vp$$

Vg remains at M2 until another cycle begins with a clock pulse S1 grounding memory nodes M1 and M2. Vg at M2 turns on evaluation transistor T4, which enables a measurement at ID 802 (the drain of transistor T4). In this implementation, it is presumed that transistor T4 is biased in the linear mode of operation, where T4 acts as a resistor whose value is proportional to the gate voltage Vg (e.g., reference voltage). The T4 resistance from drain to source (coupled to ground) is determined by forcing a small current at ID 802 (e.g., a current on the order of 1 milliamp). With additional reference to FIG. 1, ID 802 is coupled to a current source, such as current source 130 in printer ASIC 126. Upon applying the current source at ID, the voltage ($V_{ID}$) is measured at ID 802 by the ASIC 126. Firmware, such as Rsense module 128 executing on controller 110 or ASIC 126 can convert $V_{ID}$ to a resistance Rds from drain to source of the T4 transistor using the current at ID 802 and $V_{ID}$. The ADC 132 in printer ASIC 126 subsequently determines a corresponding digital value for the resistance Rds. The resistance Rds enables an inference as to the value of Vg based on the characteristics of transistor T4. Based on a value for Vg, a value of Csense can be found from the equation for Vg shown above. A level of ink can then be determined based on the value of Csense.

Once the resistance Rds is determined, there are various ways in which the level ink can be found. For example, the measured Rds value can be compared to a reference value for Rds, or a table of Rds values experimentally determined to be associated with specific ink levels. With no ink (e.g., a "dry" signal), or a very low ink level, the value of sense capacitor 352 is very low. This results in a very low Vg (on the order of 1.7 volts), and the evaluation transistor T4 is off or nearly off (e.g., T4 is in cut off or sub-threshold operation region). Therefore, the resistance Rds from ID to ground through T4 would be very high (e.g., with ID current of 1.2 mA, Rds is typically above 12 k ohm). Conversely, with a high ink level (e.g., a "wet" signal), the value of sense capacitor 352 is close to 100% of its value, resulting in a high value for Vg (on the order of 3.5 volts). Therefore, the resistance Rds is low. For example, with a high ink level Rds is below 1 k ohm, and is typically a few hundred ohms.

Figure 9:
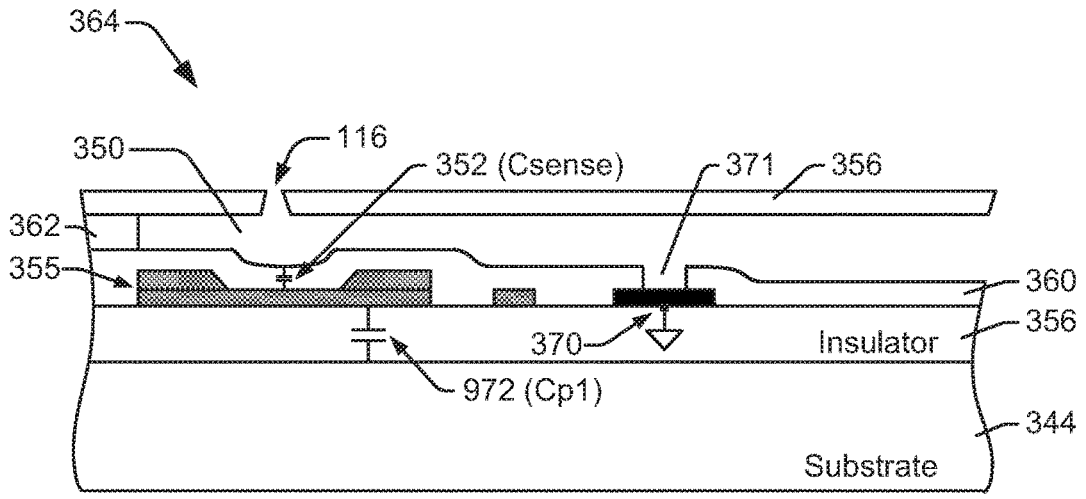
FIG. 9 is a cross-sectional view of an example sense structure with both a sense capacitor and an intrinsic parasitic capacitance.

FIG. 9 is a cross-sectional view of an example PILS sense structure 364 that illustrates both the sense capacitor 352 and an intrinsic parasitic capacitance Cp1 (972) underneath the metal plate 355 that may form part of sense capacitor 352, in accordance with various implementations. The intrinsic parasitic capacitance Cp1 972 may be formed by the metal plate 355, the insulation layer 356, and substrate 344. As described herein, a PILS 122 may determine an ink level based on the capacitance value of sense capacitor 352. When a voltage (e.g., Vp) is applied to the metal plate 355, charging the sense capacitor 352, however, the Cp1 972 capacitor also charges. Because of this, the parasitic capacitance Cp1 972 may contribute on the order of 20% of the capacitance determined for sense capacitor 352. This percentage may vary depending on the thickness of the insulation layer 356 and the dielectric constant of the insulation material. The charge remaining in the parasitic capacitance Cp1 972 in a "dry" state (e.g., where no ink is present), however, may be enough to turn on the evaluation transistor T4. The parasitic Cp1 972, therefore, may dilute the dry/wet signal.

Figure 10:
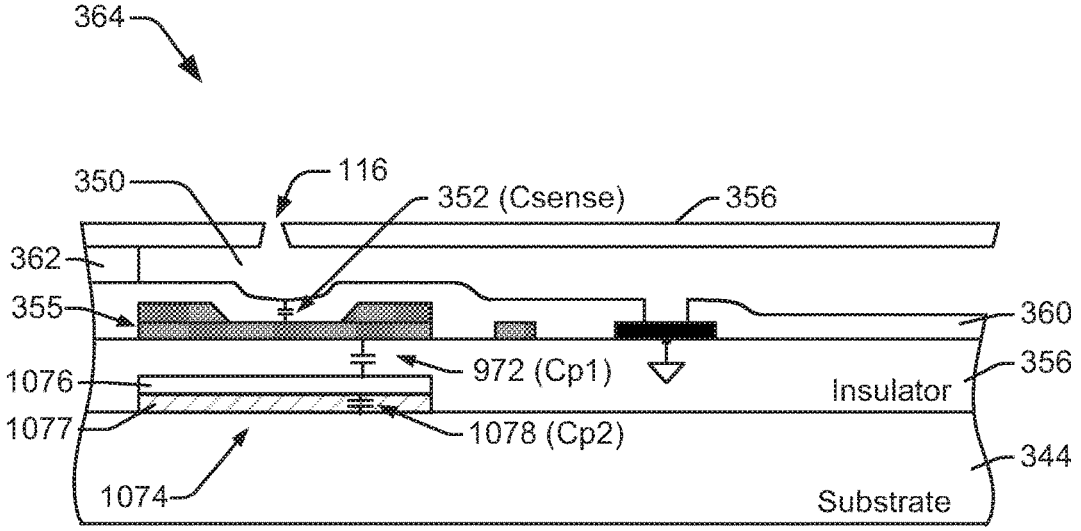
FIG. 10 is a cross-sectional view of an example sense structure that includes a parasitic elimination element.

FIG. 10 is a cross-sectional view of an example sense structure 364 that includes a parasitic elimination element 1074, in accordance with various implementations. The parasitic elimination element 1074 may comprise a conductive layer 1076 such as a polysilicon layer, which may be formed over an oxide 1077 (e.g., gate oxide layer), designed to eliminate the impact of the parasitic capacitance Cp1 972. In this configuration, when a voltage (e.g., Vp) is applied to the metal plate 355, it may also be applied to the conductive layer 1076. In various implementations, this may prevent a charge from developing on the Cp1 972 so that Cp1 is effectively virtually isolated from the determination of the sense capacitor 352 capacitance. Cp2, element 1078, may be the intrinsic capacitance from the parasitic elimination element 1074. Cp2 1078 may slow the charging speed of the parasitic elimination element 1074 but may have no impact on the removal/isolation of Cp1 972 because there is sufficient charge time provided for element 1074.

Figure 11:
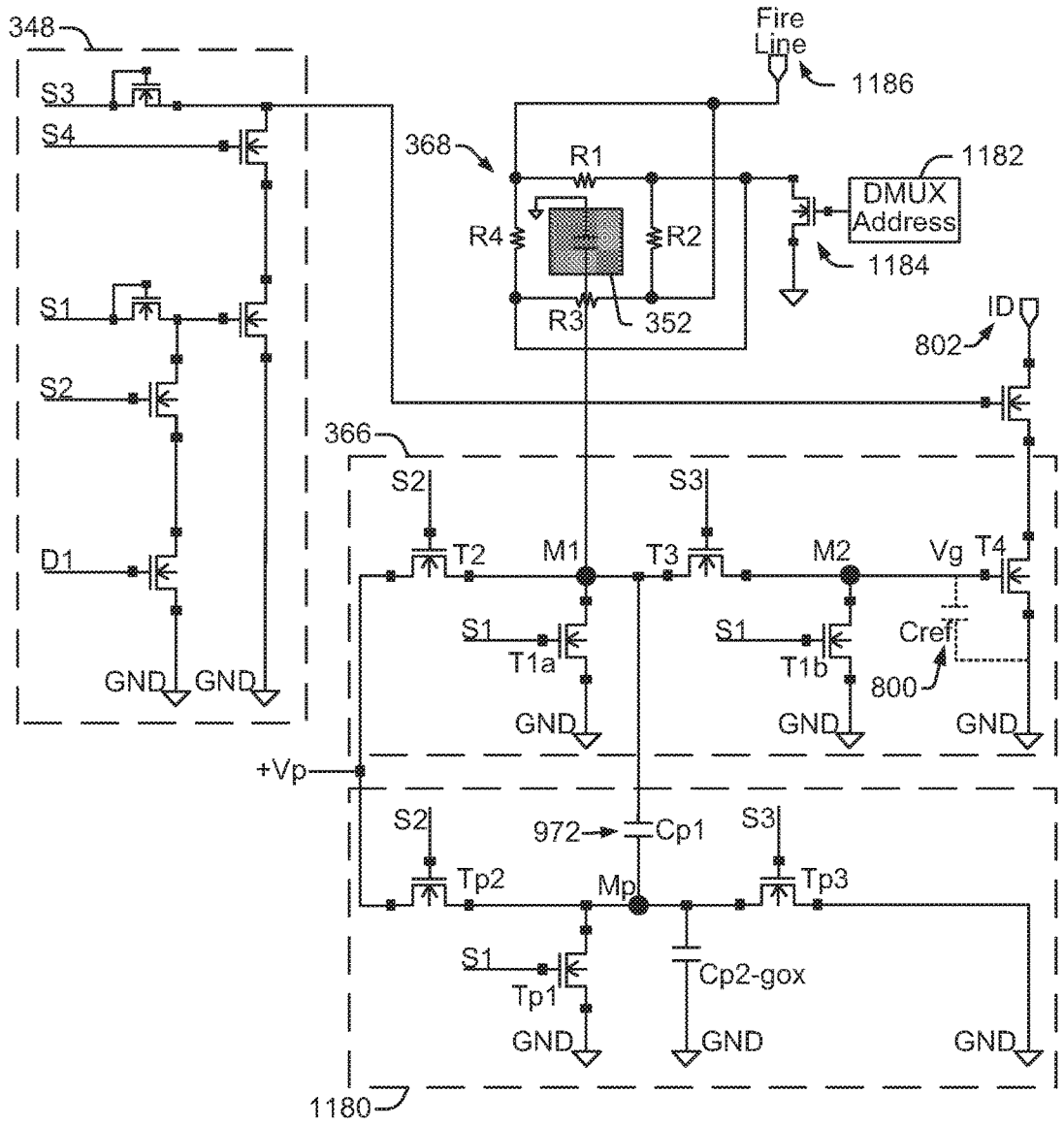
FIG. 11 is an example PILS ink level sensor circuit including a parasitic elimination circuit, a clearing resistor circuit, and shift register.

FIG. 11 is an example PILS ink level sensor circuit 366 with a parasitic elimination circuit 1180, clearing resistor circuit 368, and shift register 348, in accordance with various implementations. As noted herein, clearing resistor circuit 368 may be activated to purge ink and/or ink residue out of a PILS fluid chamber 350 prior to measuring the sensor circuit 366 at ID 802. The clearing resistors R1, R2, R3, and R4, may operate like typical TIJ firing resistors. Thus, they may be addressed by dynamic memory multiplexing (DMUX) 1182 and driven by a power FET 1184 connected to a fire line 1186. The controller 110 (FIG. 1) may control activation of clearing resistor circuit 368 through the fire line 1186 and DMUX 1182, by execution of particular firing instructions from clearing module 134, for example.

Typically, multiple sensor circuits 366 from multiple PILS 122 may be connected to a common ID 802 line. For example, a color printhead die/substrate 344 with several fluid feed slots 342 may have twelve or more PILS 122 (e.g., four PILS 122 per slot 342, as in FIG. 3). The shift register 348 may enable multiplexing the outputs of multiple PILS sensor circuits 366 onto the common ID 802 line. A PILS select module 136 executing on the controller 110 may control the shift register 348 to provide a sequenced output, or other ordered output of the multiple PILS sensor circuits 366 onto common ID 802 line.

Figure 12:
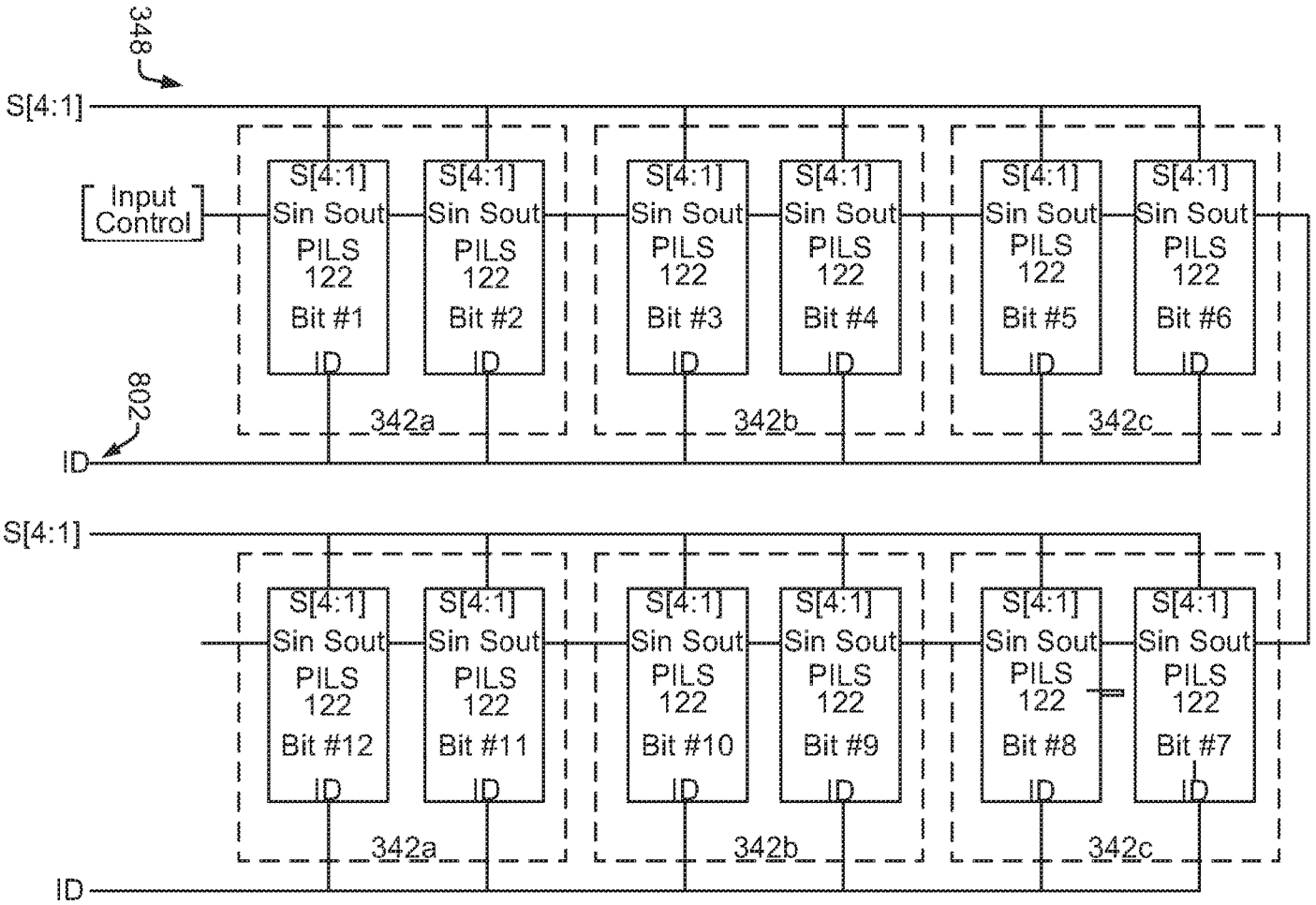
FIG. 12 is an example of a shift register that addresses a plurality of PILS signals.

FIG. 12 shows another example of a shift register 348 that addresses multiple PILS 122 signals, in accordance with various implementations. In FIG. 12, a shift register 348 comprises a PILS block selective circuit to address multiple PILS signals from twelve PILS 122. There are three slots 342 (342*a*, 342*b*, 342*c*) on a color die, with four PILS 122 for each slot 342. For implementations including more than twelve PILS 122, the shift register 348 may be similarly configured for addressing the additional PILS 122. Addressing the multiple PILS signals through shift register 348 may increase the accuracy of ink level measurements by checking various locations on the die.

Various operations of a method for forming a fluid ejection apparatus including a ground electrode exposed to a fluid chamber are illustrated in FIGS. 13-21 by way of sectional views of the apparatus at various stages of the method. It should be noted that various operations discussed and/or illustrated may be generally referred to as multiple discrete operations in turn to help in understanding various implementations. The order of description should not be construed to imply that these operations are order dependent, unless explicitly stated. Moreover, some implementations may include more or fewer operations than may be described.

Figure 13:
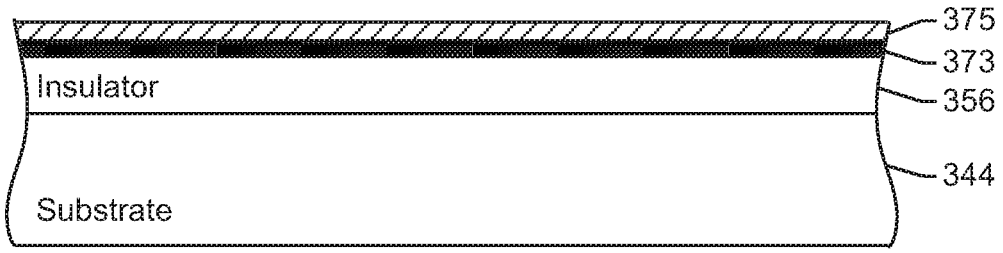
FIGS. 13-21 illustrate various stages of methods for making a sense structure of a PILS.

Turning now to FIG. 13, the first metal layer 373 of the sense structure 346 may be formed over the substrate 344, either directly or on another layer(s) directly on the substrate 344, and the second metal layer 375 may be formed over the first metal layer 373. As shown, for example, the first metal layer 373 may be formed on an insulator layer 356, which is on a substrate 344.

Figure 14:
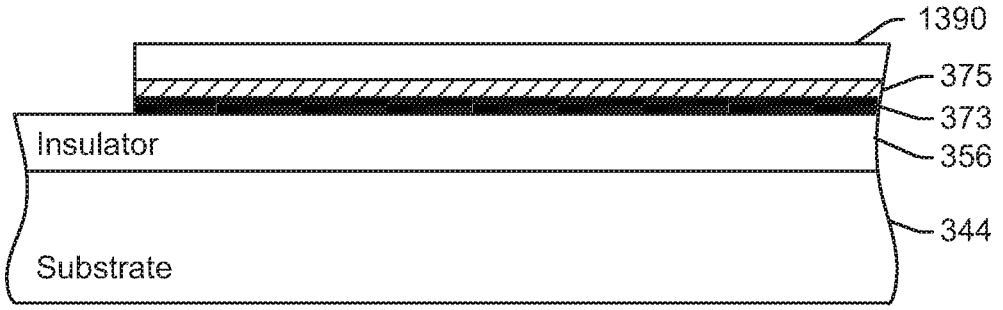

At FIG. 14, a mask 1390 may be formed over the first metal layer 373 and the second metal layer 375, and the metal layers 373, 375 may be etched. The etch operation at FIG. 14 may be performed any suitable etch operation including, for example, a plasma dry etch.

Although not illustrated in FIGS. 13 and 14, in various implementations the metal plate 155 of the sense capacitor 352 may be formed simultaneously to forming the first metal layer 373 and the second metal layer 375. In other implementations, the metal plate 155 of the sense capacitor 352 may be formed separately to forming the first metal layer 373 and the second metal layer 375.

Figure 15:
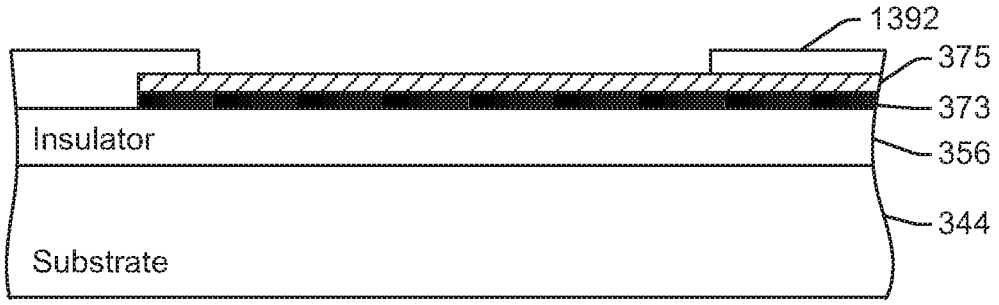
Figure 16:
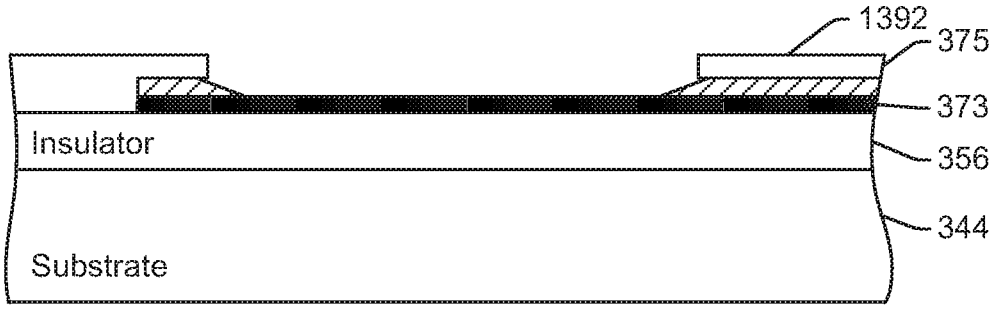
Figure 17:
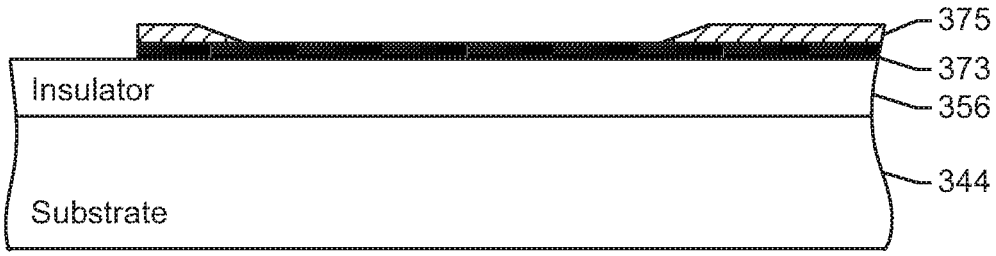

At FIG. 15, a mask 1392 may be formed over substrate 344 and over portions of the second metal layer 375, and then at FIG. 16, the second metal layer 375 may be etched such that a portion of the first metal layer 373 is exposed through the second metal layer 375 to allow the first metal layer 373 to be exposed to the fluid chamber 350 described herein. In various implementations, the second metal layer 375 may be etched using any suitable etch operation such as, for example, a wet etch. At FIG. 17, the mask 1392 may be removed.

Figure 18:
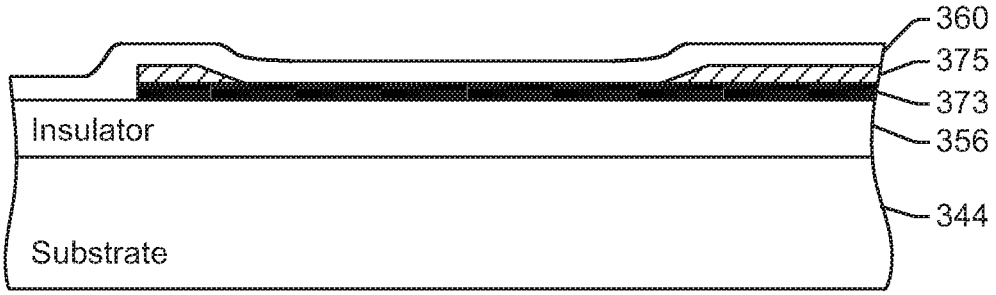
Figure 19:
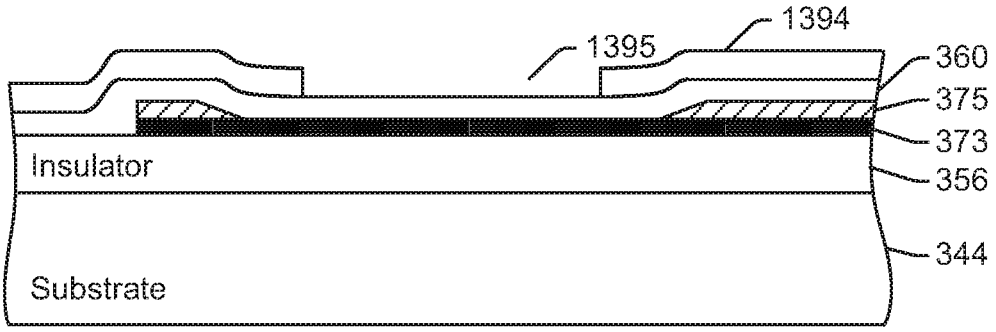
Figure 20:
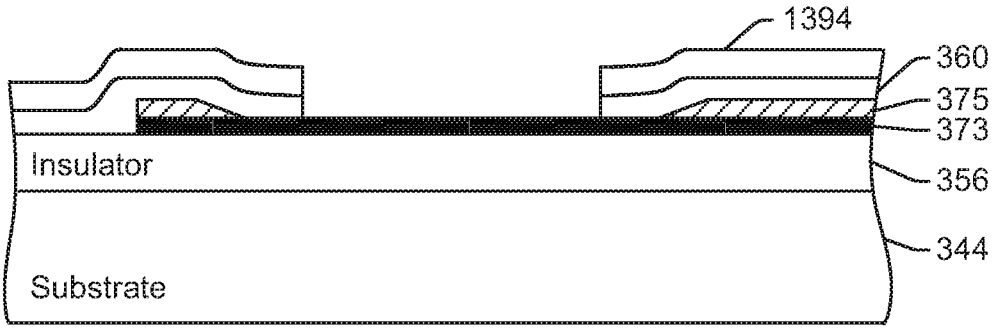
Figure 21:
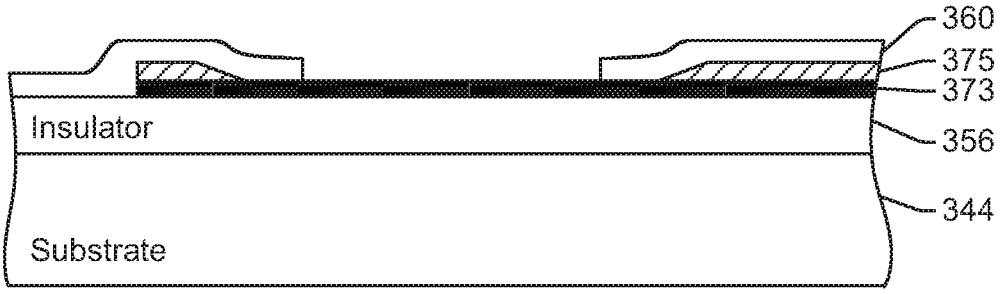

At FIG. 18, the passivation layer 360 may be formed over the metal layers 373, 375 (and over the metal plate 155 of the sense capacitor 352, though not illustrated here), and at FIG. 19, a mask 1394 may be formed over the passivation layer 360. As shown, the mask 1394 includes at least one opening corresponding to location(s) at which the via 371 is to be formed. At FIG. 20, the passivation layer 360 may be etched to form via 371 to expose a portion of the first metal layer 373 to provide a ground electrode for the sense circuit of the sensor. The mask 1394 may be removed at FIG. 21 and the method may continue with one or more operations to form, at least in part, the structure shown, for example, at FIGS. 3-6, 9, and 10. For example, the method may include forming a nozzle layer 356 over the passivation layer 360 to form the fluid chamber 350 between the nozzle layer 356 and the passivation layer 360 such that the portion of the first metal layer 373 is exposed to the fluid chamber 350 and the fluid chamber 350 fluidically couples the fluid feed slot 342 to a nozzle of the nozzle layer 356.

Although certain implementations have been illustrated and described herein, it will be appreciated by those of ordinary skill in the art that a wide variety of alternate and/or equivalent implementations calculated to achieve the same purposes may be substituted for the implementations shown and described without departing from the scope of this disclosure. Those with skill in the art will readily appreciate that implementations may be implemented in a wide variety of ways. This application is intended to cover any adaptations or variations of the implementations discussed herein. It is manifestly intended, therefore, that implementations be limited only by the claims and the equivalents thereof.

What is claimed is:

1. A cartridge comprising:

a printhead comprising:

a fluid feed slot;

a fluid chamber formed between a nozzle layer and a passivation layer, the fluid chamber fluidically coupling the fluid feed slot and a nozzle of the nozzle layer; and a printhead-integrated sensor to sense a property of a fluid in the fluid chamber, the sensor including a ground electrode exposed to the fluid chamber through an opening in the passivation layer.

2. The cartridge of claim 1, wherein the ground electrode comprises a first metal layer and a second metal layer on the first metal layer, the second metal layer connected to a ground path, and wherein the opening in the passivation layer exposes a portion of the first metal layer.

3. The cartridge of claim 2, wherein the second metal layer is shielded from the fluid chamber by the passivation layer.

4. The cartridge of claim 2, wherein the first metal layer comprises tantalum aluminum.

5. The cartridge of claim 2, wherein the second metal layer comprises aluminum copper.

6. The cartridge of claim 1, wherein the sensor comprises an ink level sensor (PILS) to sense a fluid level of the fluid in the fluid chamber, the PILS comprising a sense capacitor whose capacitance changes with a level of fluid in the fluid chamber, and the sense capacitor including a metal plate, wherein the passivation layer is between the metal plate and the fluid chamber.

7. The cartridge of claim 6, further comprising another PILS to sense a fluid level of another fluid chamber formed between the nozzle layer and the passivation layer.

8. The cartridge of claim 6, wherein the PILS is a first PILS and wherein the cartridge further comprises a second PILS, a third PILS, and a fourth PILS, wherein the first, second, third, and fourth PILS are located around the fluid feed slot.

9. The cartridge of claim 8, wherein each of the first, second, third, and fourth PILS is located near a different corner of the fluid feed slot.

10. The cartridge of claim 1, wherein the printhead further comprises a clearing resistor circuit disposed within the fluid chamber to clear the fluid chamber of fluid.

11. The cartridge of claim 1, wherein the printhead comprises a printhead die that includes the fluid feed slot, the fluid chamber, and the sensor.

12. The cartridge of claim 1, further comprising electrical contacts to communicate with a printer controller.

13. The cartridge of claim 1, further comprising a fluid reservoir storing a printing fluid.

14. A cartridge comprising:

a nozzle layer including a plurality of nozzles;

a plurality of printhead-integrated sensors including a first sensor to sense a property of a fluid in a fluid chamber fluidically coupling one of the plurality of nozzles to a fluid feed slot, the fluid chamber formed between the nozzle layer and a passivation layer, and the first sensor including a ground electrode exposed to the fluid chamber through a via in the passivation layer; and a shift register to select between the plurality of printhead-integrated sensors for output onto a line.

15. The cartridge of claim 14, wherein the plurality of printhead-integrated sensors includes a plurality of printhead-integrated ink level sensors (PILS), each PILS including a sense capacitor whose capacitance changes with a level of fluid in a respective fluid chamber.

16. The cartridge of claim 15, further comprising:

a first switch to apply a voltage to the sense capacitor to place a charge on the sense capacitor;

a second switch to share the charge between the sense capacitor and a reference capacitor, resulting in a reference voltage; and an evaluation transistor to provide a drain to source resistance in proportion to the reference voltage.

17. The cartridge of claim 14, further comprising a controller to control the shift register to select between the plurality of printhead-integrated sensors.

18. A cartridge comprising:

a printhead die comprising:

a substrate;

a sensor formed over the substrate;

a first metal layer over the substrate;

a second metal layer over the first metal layer, wherein a portion of the first metal layer is exposed through the second metal layer;

a passivation layer over the first metal layer and the second metal layer, the passivation layer having a via to expose the portion of the first metal layer to provide a ground electrode for the sensor; and a nozzle layer over the passivation layer to form a fluid chamber between the nozzle layer and the passivation layer, wherein the portion of the first metal layer is exposed to the fluid chamber.

19. The cartridge of claim 18, wherein the sensor comprises a sense capacitor.

20. The cartridge of claim 18, wherein the printhead die further comprises a thermal resistor that when heated forces fluid out of the fluid chamber through a nozzle in the nozzle layer.

* * * * *